US006339988B1

(12) United States Patent
Schäfer

(10) Patent No.: US 6,339,988 B1
(45) Date of Patent: Jan. 22, 2002

(54) CYLINDER WITH A RUBBER COVER

(75) Inventor: Karl Robert Schäfer, Rimpar (DE)

(73) Assignee: Koenig & Bauer Aktiengellschaft, Wurzburg (DE)

( * ) Notice: Subject to any disclaimer, the term of this patent is extended or adjusted under 35 U.S.C. 154(b) by 0 days.

(21) Appl. No.: 09/424,834

(22) PCT Filed: May 28, 1998

(86) PCT No.: PCT/DE98/01462

§ 371 Date: Dec. 2, 1999

§ 102(e) Date: Dec. 2, 1999

(87) PCT Pub. No.: WO98/55314

PCT Pub. Date: Dec. 10, 1998

(30) Foreign Application Priority Data

Jun. 3, 1997 (DE) ..... 197 23 123

(51) Int. Cl.[7] ..... B41F 31/00

(52) U.S. Cl. ..... 101/351.7; 351/376; 492/28; 492/48

(58) Field of Search ..... 101/137, 142, 101/217, 376, 379, 401.1, 492, 378, 383, 148, 205–207, 314, 320, 323, 326, 328–331, 348–350.1, 351.7, 352.11, 367; 492/28, 48, 56; 428/909

(56) References Cited

U.S. PATENT DOCUMENTS

| | | | | | |
|---|---|---|---|---|---|
| 3,559,572 | A | * | 2/1971 | Hackley | 101/350 |
| 3,614,926 | A | * | 10/1971 | Brechtel | 10/1 |
| 3,857,745 | A | * | 12/1974 | Grausch et al. | 156/83 |
| 4,043,013 | A | * | 8/1977 | Zeppernick et al. | 29/132 |
| 4,466,349 | A | | 8/1984 | Bartlett | |
| 4,766,811 | A | * | 8/1988 | Linska | 101/415.1 |
| 4,805,530 | A | | 2/1989 | Kobler et al. | |
| 5,046,418 | A | * | 9/1991 | Koehler et al. | 101/148 |
| 5,060,571 | A | * | 10/1991 | John | 101/350 |
| 5,233,922 | A | * | 8/1993 | Stirbis et al. | 101/363 |
| 5,558,021 | A | * | 9/1996 | Erhard et al. | 101/232 |
| 5,732,630 | A | * | 3/1998 | Puschnerat et al. | 101/415.1 |
| 5,806,420 | A | * | 9/1998 | Erhard et al. | 101/37 |

FOREIGN PATENT DOCUMENTS

| | | | |
|---|---|---|---|
| DE | 2433749 | B2 | 8/1976 |
| DE | 2937793 | A1 | 4/1981 |
| DE | 19517653 | A1 | 12/1995 |
| EP | 0279295 | A2 | 2/1988 |
| EP | 0280140 | A2 | 2/1988 |
| WO | 96/35582 | * | 11/1996 |

* cited by examiner

*Primary Examiner*—Eugene Eickholt
(74) *Attorney, Agent, or Firm*—Jones, Tullar & Cooper, PC

(57) ABSTRACT

An inking cylinder or a dampening cylinder or roller for a rotary printing press is provided with a rubber cover that is adhered to the body of the cylinder or roller. A device for applying the rubber cover to the roller body includes a support table that is pivotably supported.

4 Claims, 2 Drawing Sheets

CYLINDER WITH A RUBBER COVER

FIELD OF THE INVENTION

The present invention relates to a cylinder with a rubber covering, as well as to a device for applying the rubber covering.

DESCRIPTION OF THE PRIOR ART

It is known to coat a cylinder with rubber, for example by vulcanizing.

It is disadvantageous here that it is necessary to finish the surface of the rubber covering, for example by grinding. This, in turn, leads to relief formations on the surface of the rubber covering, so that irregularities are caused when transferring liquid or pasty materials.

EP 0279295 A2 describes an inking system of a printing press, wherein an inking roller is provided with a rubber blanket.

DE 19517653 A1 discloses a roller for a printing press, whose basic body is enclosed in a hose made of an elastomeric material.

SUMMARY OF THE INVENTION

The object of the present invention is based on providing an inking or dampening agent roller with a rubber coating, as well as to a device for applying the rubber coating.

In accordance with the present invention, this object is attained by the provision of an inking and dampening agent roller having a roller body with a rubber covering. The covering consists of a finite rubber blanket whose entire underside is adhesively bonded to the roller body. A joint line formed by the start and end of the rubber covering is angled with respect to the axis of rotation of the roller.

The advantages to be obtained by the present invention lie, in particular, in that an essentially homogeneous surface of the rubber covering fastened to the basic roller body is achieved. This, in turn, has the result that the even transfer of pasty or liquid materials is assured.

BRIEF DESCRIPTION OF THE DRAWINGS

A preferred embodiment of the present invention is represented in the drawings and will be described in greater detail in what follows. Shown are in.

DESCRIPTION 0F THE PREFERRED EMBODIMENT

Figures 1, 3:
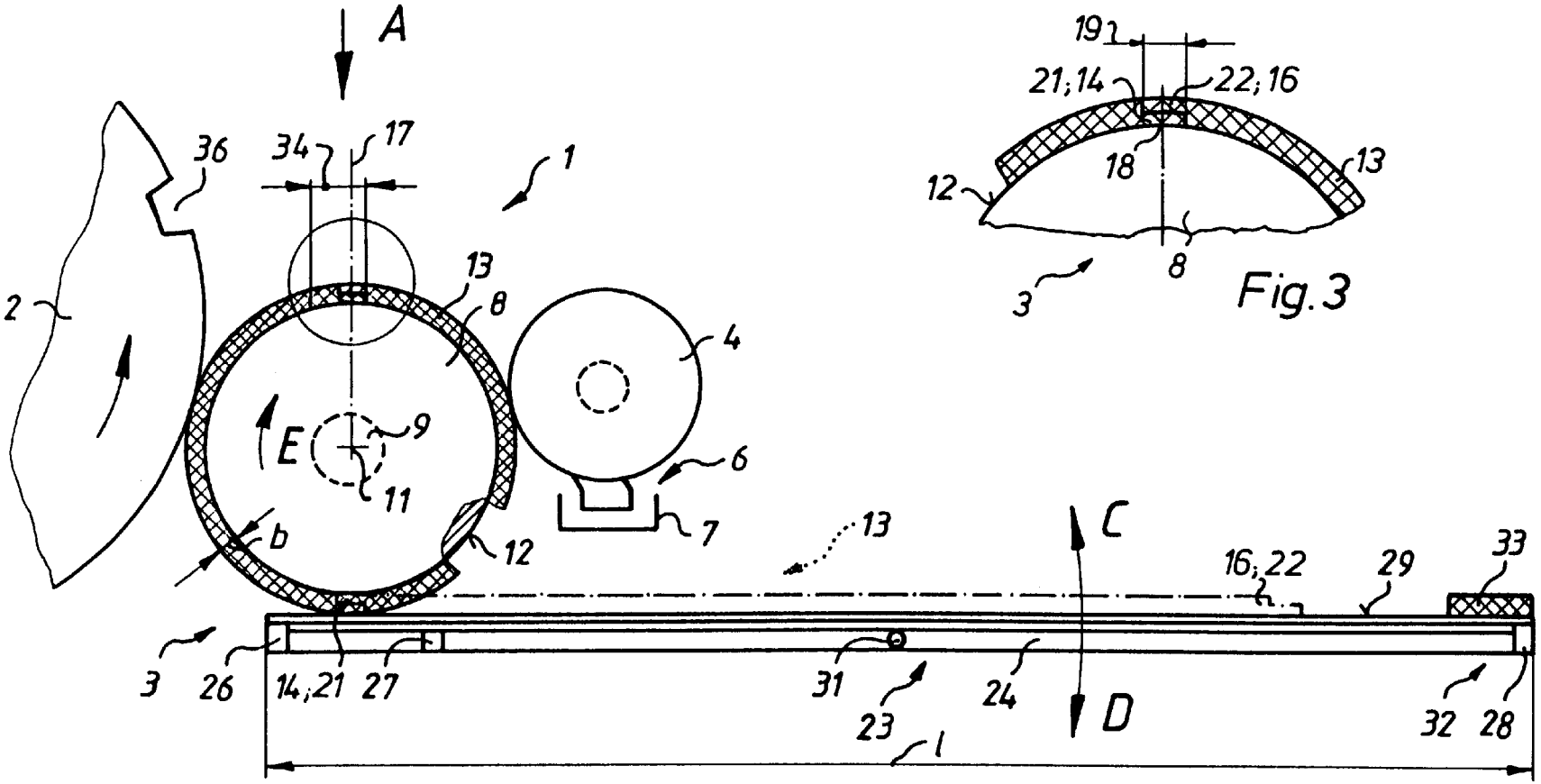
FIG. 1, a cross sectional view with a schematic representation of an ink application roller with a rubber covering in a short inking system, as well as a device for applying the rubber covering.

A short inking system 1 for a rotary printing press consists, for example, of a printing or rubber blanket cylinder, not specifically represented, and a forme cylinder 2, to which pasty ink is transferred from a screen roller 4 by means of an ink application roller 3, as depicted in FIG. 1. The screen roller 4 is supplied with ink by a chamber doctor blade installation 6. An ink collecting pan 7 is arranged underneath the chamber doctor blade installation 6. The above mentioned elements are seated fixed in a lateral frame, not specifically shown.

Figure 2:
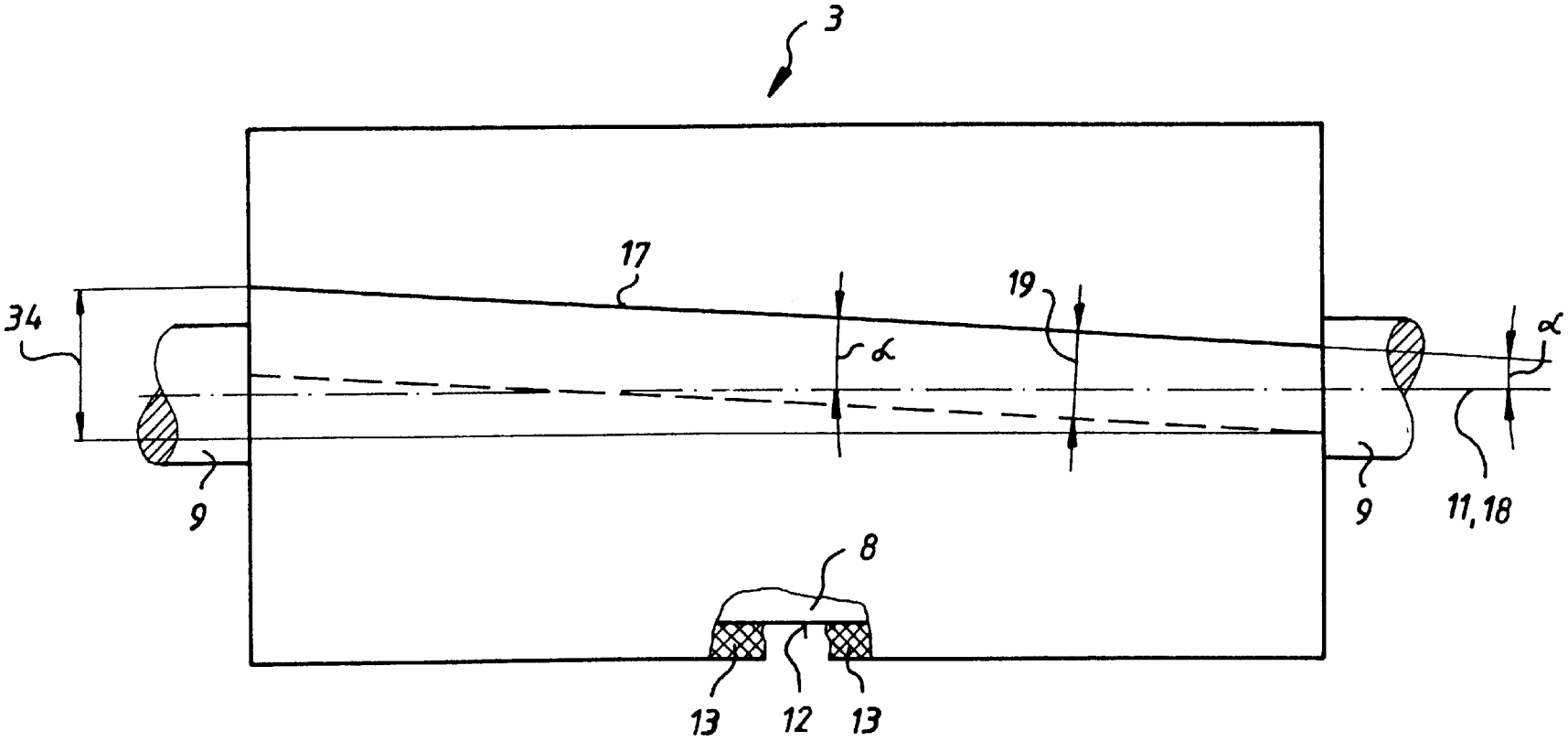
FIG. 2, a view from above of the roller in FIG. 1 in an enlarged representation, and in FIG. 3, an enlarged detail in accordance with FIG. 1.

The ink application roller 3, hereafter referred to as roller 3, consists of a basic roller body 8 with two shaft journals 9, which rotate around an axis of rotation 11, as may be seen in FIGS. 1 and 2. A self-adhesive rubber blanket 13 of a thickness "b", for example, of 2.3 mm, is situated on the entire surface or surface area 12 of the basic roller body 8. A double-sided adhesive foil, or an application of adhesive of a thickness of approximately 0.3 mm can be provided here. By means of this adhesive or adhesive foil it is achieved that the rubber blanket 13 is glued on its entire underside on the surface area 12.

The rubber blanket 13 is envelope-like and has a start 14 and an end 16. After having been applied to the roller 3, the start 14 and the end 16 meet along a separation or joint line 17 and may form a butt joint. Referred to an unrolled rubber blanket 13, this joint line 17 extends at an angle $\alpha$ in relation to a line 18 extending parallel to the axis of rotation 11 of the basic roller body 8, as may be seen in FIG. 2. The angle $\alpha$ lies between greater than zero degrees and six degrees, and preferably at three degrees.

In accordance with further preferred embodiments, the start 14 and the end 16 of the rubber blanket 13 can overlap in the form of an offset joint or a tapered overlap joint. For this purpose, the start 14 and the end 16 each have tabs 21, 22, which are designed to be of reduced thickness, for example of five to ten millimeters, and which are placed on top of each other in a joint area 19 as seen most clearly in FIG. 3. The rubber blanket material is known and is commercially available for use with a rubber blanket cylinder in offset rotary printing presses.

The rubber blanket 13 is applied as follows: a rubber blanket support, for example a table 23, is made of a profiled iron frame having two spaced apart longitudinal guides 24, only one is represented, which are connected by means of three transverse profiles 26, 27, 28.

The table 23 is covered on its surface, for example with sheet metal 29. The transverse profiles 26 and 27 are arranged directly to the left and right under the roller 3, so that in this strip-shaped area a special resilient effect and good adaptation to the radius is achieved by means of the sheet metal 29.

The table 23 is pivotably supported by means of bolts 31 in the not represented lateral frame of the rotary printing press at about half its length "1". As depicted in FIG. 1, a rubber blanket 13—shown in dashed lines—is placed on the table 23 with the side coated with adhesive facing up. A detent strip for the start 14 of the rubber blanket 13 can also be provided parallel with the transverse profiles 26, 27, but on the side of the sheet metal 29 opposite to profiles 26 and 27

After the roller 3 has taken up a correct register position, the end 32 of the table 23 which is remote from the roller is pushed into a lower position D. The roller is rotated at creep speed in the clockwise direction E until, after a complete revolution of the roller 3, the rubber blanket 13 has been completely applied to the basic roller body 8.

Thereafter, the table 23 is pivoted upward in the direction C, or respectively lifted out at the bolts 31. A quick-setting adhesive, for example, is applied in the axis-parallel direction between the strip-shaped tabs 21, 22, and the facing sides of the tabs 21, 22 are placed on top of each other and caused to adhere by pressing them down for approximately 10 to 20 seconds. The pressing can take place, for example, in that the table 23 is turned by 180°, and is re-suspended from the bolts 31 in such a way that the end 32 is underneath the roller 3. In the course of this, a strip 33 of foam rubber can be pressed on the joint area 19.

If the joint line extends at an angle $\alpha$ in respect to the line 18, the joint area 19 is enlarged to form an even wider joint area 34.

In accordance with another preferred embodiment which is not specifically represented table 23 can also be arranged to be movable by means of a frame, i.e. not fixed in the lateral frame.

To fasten or position the rubber blanket 13 at the correct register means that the joint area 19, or respectively 34, of the cylinder 3 corresponds, as much as possible, with a print-free strip, for example a cylinder channel 36 of the plate cylinder 2. It is advantageous if the circumferential width of the cylinder pit 36 is greater than the joint area 34.

The roller 3 can be used as a rubberized inking roller or as a rubberized damping agent roller with dampening systems. In this case, the roller 3 can be preferably placed directly against a forme cylinder, for example the plate cylinder 2.

The hardness of the rubber blanket is 65 to 70 Shore. While preferred embodiments of a cylinder with a rubber cover and a device for applying the cover in accordance with the present invention have been set forth fully and completely hereinabove, it will be apparent to one of skill in the art that a number of changes in, for example, the overall size of the cylinder, the specific type of rotary printing press and the like could be made without departing from the true spirit and scope of the present invention which is accordingly to be limited only by the following claims.

What is claimed is:

1. An inking and dampening agent roller for a rotary printing press comprising:

a roller body having a roller body surface and an axis of rotation;

a rubber covering on said roller body, said rubber covering being formed by the placement of a finite length rubber blanket onto said roller body surface, said finite length rubber blanket including an underside, a start and an end;

an adhesive bond between said underside of said finite length rubber blanket and said surface of said roller body; and a joint formed by the meeting of said start and said end of said finite length rubber blanket placed on said roller body surface, said joint defining an angled joint line, said angled joint line extending at an angle between greater than 0° and 6° on said roller body surface with respect to said axis of rotation of said roller body.

2. The inking and dampening agent roller of claim 1 wherein said rubber blanket is self-adhesive.

3. The inking and dampening agent roller of claim 1 wherein said roller body is provided with an adhesive.

4. The inking and dampening agent of roller 1 wherein said rubber covering can be brought into rolling contact with a screen roller and a forme cylinder of the rotary printing press.

* * * * *